US010460736B2

(12) United States Patent
Chon et al.

(10) Patent No.: US 10,460,736 B2
(45) Date of Patent: Oct. 29, 2019

(54) METHOD AND APPARATUS FOR RESTORING AUDIO SIGNAL

(71) Applicant: SAMSUNG ELECTRONICS CO., LTD., Suwon-si (KR)

(72) Inventors: Sang-bae Chon, Suwon-si (KR); Sun-min Kim, Yongin-si (KR); Yoon-jae Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 160 days.

(21) Appl. No.: 15/525,181

(22) PCT Filed: Oct. 8, 2015

(86) PCT No.: PCT/KR2015/010665

§ 371 (c)(1),
(2) Date: May 8, 2017

(87) PCT Pub. No.: WO2016/072628

PCT Pub. Date: May 12, 2016

(65) Prior Publication Data

US 2017/0337926 A1 Nov. 23, 2017

Related U.S. Application Data

(60) Provisional application No. 62/076,727, filed on Nov. 7, 2014.

(51) Int. Cl.

*G10L 19/00* (2013.01)
*G10L 19/02* (2013.01)
(Continued)

(52) U.S. Cl.

CPC ..... *G10L 19/0017* (2013.01); *G10L 19/02* (2013.01); *G10L 21/038* (2013.01); *G10L 25/18* (2013.01)

(58) Field of Classification Search

CPC ..... G10L 19/00; G10L 21/038
See application file for complete search history.

(56) References Cited

U.S. PATENT DOCUMENTS 6,704,711 B2 3/2004 Gustafsson et al.
9,571,424 B2 2/2017 Liu
(Continued)

FOREIGN PATENT DOCUMENTS

JP 2007-43295 A 2/2007
JP 2008-122597 A 5/2008
(Continued)

OTHER PUBLICATIONS

Written Opinion (PCT/ISA/237) dated Feb. 24, 2016 issued by International Searching Authority in counterpart International Application No. PCT/KR2015/010665.
(Continued)

*Primary Examiner* — Samuel G Neway
(74) *Attorney, Agent, or Firm* — Sughrue Mion, PLLC

(57) ABSTRACT

Provided is a method of reconstructing an audio signal, the method including detecting a lossy frequency band, based on an energy value of each of frequencies of the audio signal; obtaining a cut-off frequency, based on the lossy frequency band; and reconstructing the audio signal of the lossy frequency band, based on the cut-off frequency.

10 Claims, 8 Drawing Sheets

(51) Int. Cl.
*G10L 21/038* (2013.01)
*G10L 25/18* (2013.01)

(56) References Cited

U.S. PATENT DOCUMENTS 9,596,542 B2 3/2017 Lee et al.
9,881,624 B2 * 1/2018 Choo ..... G10L 19/002
2002/0016698 A1 * 2/2002 Tokuda ..... G10L 21/038 702/190
2003/0233234 A1 * 12/2003 Truman ..... G10L 19/035 704/203
2006/0031075 A1 * 2/2006 Oh ..... G10L 19/04 704/500
2006/0190254 A1 * 8/2006 Iser ..... G10L 21/038 704/243
2007/0129036 A1 6/2007 Arora
2008/0129350 A1 * 6/2008 Mitsufuji ..... G10L 21/038 327/113
2008/0312759 A1 * 12/2008 Koishida ..... G10L 19/0208 700/94
2013/0054253 A1 * 2/2013 Shirakawa ..... G10L 19/008 704/500
2014/0350922 A1 * 11/2014 Ohtani ..... G10L 25/18 704/205
2015/0149156 A1 * 5/2015 Atti ..... G10L 19/265 704/205
2016/0118056 A1 * 4/2016 Choo ..... G10L 19/002 381/100
2017/0337926 A1 * 11/2017 Chon ..... G10L 19/0017

FOREIGN PATENT DOCUMENTS

JP 2013-17022 A 1/2013
KR 10-0663379 B1 1/2007
KR 10-0717058 B1 5/2007
KR 10-2013-0117908 A 10/2013
WO 2014/012391 A1 1/2014

OTHER PUBLICATIONS

International Search Report (PCT/ISA/210) dated Feb. 24, 2016 issued by International Searching Authority in counterpart International Application No. PCT/KR2015/010665.
Communication dated Dec. 14, 2018, issued by the Korean Intellectual Property Office in counterpart Korean Application No. 10-2017-7010269.
Yong-tao Sha et al. "High frequency reconstruction of audio signal based on chaotic prediction theory" 2010 IEEE International Conference on Acoustics Speech and Signal Processing, Mar. 14, 2010 (pp. 381-384).
Communication dated Jun. 7, 2019, issued by the Korean Patent Office in counterpart Korean Application No. 10-2017-7010269.
Communication dated Jul. 11, 2019, issued by the Korean Patent Office in counterpart Korean Application No. 10-2017-7010269.

* cited by examiner

METHOD AND APPARATUS FOR RESTORING AUDIO SIGNAL

TECHNICAL FIELD

The present invention relates to a method and apparatus for reconstructing an audio signal where data of some frequency bands is lossy.

BACKGROUND ART

When an audio signal is compressed or transmitted, an audio signal of some frequency bands may be lossily compressed or transmitted for efficient compression or transmission. The audio signal where data of some frequency bands is lossy may have a deteriorated sound quality or tone, compared to an audio signal before the loss.

Therefore, in order for an audio signal including a lossy frequency band to be reproduced close to an original sound with a high sound quality, it is required to effectively reconstruct an audio signal of the lossy frequency band.

DETAILED DESCRIPTION OF THE INVENTION

Technical Solution

The present invention relates to a method and apparatus for reconstructing an audio signal where some frequency bands are lossy. More particularly, the present invention relates to a method and apparatus for detecting and reconstructing the audio signal where some frequency bands are lossy, based on an energy value of each frequency.

Advantageous Effects

According to an embodiment, a sound quality of an audio signal may be improved by reconstructing a lossy frequency band of the audio signal.

BEST MODE

Figure 1:
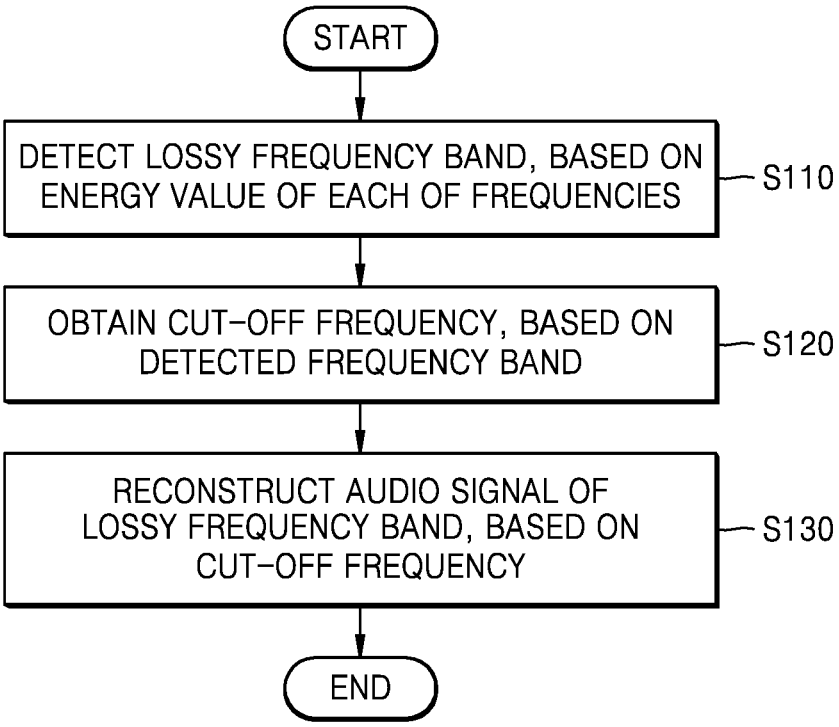
FIG. 1 is a flowchart illustrating a method of reconstructing an audio signal, according to an embodiment.

According to an embodiment, there is provided a method of reconstructing an audio signal, the method including detecting a lossy frequency band, based on an energy value of each of frequencies of the audio signal; obtaining a cut-off frequency, based on the lossy frequency band; and reconstructing the audio signal of the lossy frequency band, based on the cut-off frequency.

The detecting may include converting the audio signal to a signal in a frequency domain; detecting a frequency band from the audio signal in the frequency domain, wherein an amount of energy decrease in the frequency band is equal to or greater than a first reference value; and detecting, based on the detected frequency band, a section where an energy value is equal to or less than a second reference value, as the lossy frequency band.

The reconstructing may include setting, based on the cut-off frequency, a frequency band in the audio signal, as a frequency band to be used in the reconstructing; and reconstructing the audio signal of the lossy frequency band by using an audio signal of the set frequency band.

The reconstructing may include analyzing a signal characteristic of the set frequency band; estimating a signal characteristic of the lossy frequency band, based on the analyzed signal characteristic; and adjusting a magnitude of the lossy frequency band, based on the estimated signal characteristic.

The reconstructing may include obtaining a frequency value of an audio signal used in reconstructing an audio signal of at least one frequency from among the lossy frequency band; obtaining a phase shift amount in preset units of time with respect to the obtained frequency value; and adjusting a phase with respect to a value of the at least one frequency, based on the phase shift amount.

The adjusting of the phase may include obtaining a ratio between the obtained frequency value and the value of the at least one frequency; estimating, based on the obtained ratio and the phase shift amount, a phase shift amount with respect to the value of the at least one frequency; and adjusting the phase with respect to the value of the at least one frequency, based on the estimated phase shift amount.

The cut-off frequency may be determined in preset units of time, and the audio signal of the lossy frequency band may be reconstructed in the preset units of time, based on the cut-off frequency.

When a plurality of cut-off frequencies determined based on the detected frequency band exist, the obtaining of the cut-off frequency may include determining a greatest value from among the determined cut-off frequencies, as the cut-off frequency.

According to an embodiment, there is provided an apparatus for reconstructing an audio signal, the apparatus including a receiver configured to obtain the audio signal; a controller configured to detect a lossy frequency band, based on an energy value of each of frequencies of the audio signal, to obtain a cut-off frequency, based on the lossy frequency band, and to reconstruct the audio signal of the lossy frequency band, based on the cut-off frequency; and a speaker configured to output the reconstructed audio signal.

According to an embodiment, there is provided a method of extending a bandwidth of an audio signal, the method including extending an audio signal of a first bandwidth to an audio signal of a second bandwidth; detecting a phase shift amount of the audio signal of the first bandwidth; and compensating for, by using the phase shift amount, a phase of the audio signal extended to the second bandwidth.

MODE OF THE INVENTION

Hereinafter, embodiments of the present invention are described in detail with reference to attached drawings. In the following description and the attached drawings, well-known functions or constructions are not described in detail since they would obscure the present invention with unnecessary detail. Also, like reference numerals in the drawings denote like or similar elements throughout the specification.

Terms or words used in the following description should not be construed as being limited to common or general meanings but should be construed as fully satisfying the concept of the present invention, according to the principle by which an inventor may appropriately define terms so as to best describe his/her own invention. Therefore, the embodiments described in the specification and configurations shown in the drawings are merely examples of the present invention and do not represent all technical concepts of the present invention, and the present invention may include all revisions, equivalents, or substitutions of the embodiments at the time of filing.

In the attached drawings, some elements may be exaggerated, omitted, or roughly illustrated, and the size of each element does not exactly correspond to an actual size of each element. The present invention is not limited to relative sizes or gaps illustrated in the drawings.

Throughout the specification, when a part "includes" or "comprises" an element, unless there is a particular description contrary thereto, the part can further include other elements, not excluding the other elements. Also, when an element is referred to as being "connected to" or "coupled with" another element, it can be "directly connected to or coupled with" the other element, or it can be "electrically connected to or coupled with" the other element by having an intervening element interposed therebetween.

A singular form may include plural forms, unless there is a particular description contrary thereto. Terms such as "comprise" or "comprising" are used to specify existence of a recited form, a number, a process, an operation, a component, and/or groups thereof, not excluding the existence of one or more other recited forms, one or more other numbers, one or more other processes, one or more other operations, one or more other components and/or groups thereof.

The term "unit" used in the specification means a software component or hardware components such as an FPGA or an ASIC, and performs a specific function. However, the term "unit" is not limited to software or hardware. The "unit" may be formed so as to be in an addressable storage medium, or may be formed so as to operate one or more processors. Thus, for example, the term "unit" may refer to components such as software components, object-oriented software components, class components, and task components, and may include processes, functions, attributes, procedures, subroutines, segments of program code, drivers, firmware, micro codes, circuits, data, a database, data structures, tables, arrays, or variables. A function provided by the components and "unit" may be associated with the smaller number of components and "unit", or may be divided into additional components and "units".

While terms "first" and "second" are used to describe various components, it is obvious that the components are not limited to the terms "first" and "second". The terms "first" and "second" are used only to distinguish between each component.

The present invention will now be described more fully with reference to the accompanying drawings, in which exemplary embodiments of the invention are shown. The invention may, however, be embodied in many different forms and should not be construed as being limited to the embodiments set forth herein. In the following description, well-known functions or constructions are not described in detail since they would obscure the invention with unnecessary detail, and like reference numerals in the drawings denote like or similar elements throughout the specification.

Hereinafter, the exemplary embodiments of the present invention will be described with reference to the attached drawings.

FIG. 1 is a flowchart illustrating a method of reconstructing an audio signal, according to an embodiment.

Referring to operation S110 of FIG. 1, an apparatus for reconstructing an audio signal may detect a lossy frequency band, based on an energy value of each of frequencies.

An audio signal that may be reconstructed according to the embodiment may include various types of a signal. For example, the audio signal may include a music signal, a voice signal, or an acoustic signal where music and voice are mixed. The audio signal may include, other than the aforementioned examples, various types of a signal where a lossy frequency band may exist.

The audio signal may have a frequency band that is lossy due to various reasons. For example, audio data of a high frequency band may be lossy due to compression. When an audio signal is compressed by a lossy compression method such as MPEG-1 Audio Layer 3 (MP3), advanced audio coding (AAC), and the like, audio data of a high frequency band excluding an audible frequency band may be lossy from among data of the compressed audio signal. Therefore, in a case of the audio signal compressed by the lossy compression method, the audio data of the high frequency band is lossy such that a tone or sound quality of the audio signal may deteriorate.

As another example, audio data of some frequency bands may be lossy during transmission or storage of audio data. Audio data of some high frequency bands may be determined to be relatively less important than audio data of a low frequency band. Therefore, during transmission or storage of data, the audio signal may be transmitted or may be stored while an audio signal of some high frequency bands is omitted. A tone of the audio signal where the audio data of some frequency bands is lossy may be changed or a sound quality of the audio signal may deteriorate. The audio signal including the lossy frequency band according to the embodiment may include the lossy frequency band due to various reasons, other than the aforementioned example.

The apparatus may detect the lossy frequency band of the audio signal, based on an energy value of each of frequencies of the audio signal. The apparatus may perform frequency conversion on an audio signal in a time domain, thereby obtaining an audio spectrum including the energy value of each frequency of the audio signal. For example, the apparatus may perform frequency conversion on an audio signal in a time domain belonging to one frame.

The energy value of each frequency may be expressed as a decibel (dB) value in the audio spectrum. The energy value of each frequency may be expressed in various units, not limited to the aforementioned description. The energy value of each frequency included in the audio spectrum may mean power, a norm value, a strength, an amplitude, or the like.

In a frequency band where a loss does not occur, an energy value may be slowly decreased toward the high frequency band. On the other hand, in the audio signal where some frequency domains are lossy due to various reasons such as compression, an energy value of the high frequency band is sharply decreased with respect to a preset frequency value, so that a decreased energy value may have 0 or a value close to 0 in a preset frequency band. Compressed audio data may include an audio signal of only some frequency bands. Since an audio signal in a high frequency domain may be lossy with respect to the preset frequency value, an energy value of a lossy high frequency band may have a value of 0 or a value close to 0. Also, since audio data of a high frequency band which is relatively less important is lossy during transmission of data, an energy value of a high frequency band with respect to the preset frequency value may have 0 or a value close to 0.

An audio signal of the high frequency band may be determined to be relatively less important than audio data of a low frequency band. Therefore, audio data of the high frequency band may be lossy due to various reasons such as compression, data transmission, and the like.

Not limited to the high frequency band, an energy value of an audio signal may be sharply decreased in some frequency bands and thus may have 0 or a value close to 0. The apparatus may detect, as a lossy frequency domain, some frequency bands where the energy value is sharply decreased and thus has 0 or a value close to 0.

For example, the apparatus may detect, from an audio signal in a frequency domain, a frequency band where an amount of energy decrease between adjacent frequency bands is equal to or greater than a first reference value. Then, the apparatus may detect, based on the detected frequency band, a section where an energy value is equal to or less than a second reference value, as a lossy frequency band.

In addition, the apparatus may detect the lossy frequency band according to compression information about the audio signal. The compression information may include information about a frequency domain that may be lost during compression. However, since the apparatus is capable of detecting the lossy frequency band, based on an energy value of each of frequencies of the audio signal, the apparatus may further correctly detect the lossy frequency domain of the audio signal, compared to a method of detecting the lossy frequency domain by considering only the compression information about the audio signal.

In operation S120, the apparatus may obtain a cut-off frequency, based on the frequency band detected in operation S110. The cut-off frequency may be a frequency that is a reference when audio data of a predefined frequency band is lossy. For example, the cut-off frequency may be a minimum frequency of the high frequency band to be lossy during compression.

The cut-off frequency may be obtained with respect to the frequency band detected in operation S110. For example, the cut-off frequency may be determined as a frequency of the lossy frequency band where an amount of energy decrease between adjacent frequency bands is equal to or greater than a first reference value, and a decreased energy value is equal to or less than a second reference value.

In operation S130, the apparatus may reconstruct the audio signal of the lossy frequency band, based on the cut-off frequency obtained in operation S120. The apparatus may reconstruct the audio signal of the lossy frequency band by using an audio signal of a non-lossy frequency band, based on the cut-off frequency.

The apparatus may reconstruct, by using a magnitude of the non-lossy frequency band, a magnitude of the lossy frequency band to as to make the magnitude of the lossy frequency band not sharply decreased. A magnitude of a frequency band may be an energy value in an audio spectrum. For example, the apparatus may reconstruct a component of the lossy frequency band by using a component of the non-lossy frequency band, in an audio spectrum indicating an energy of the audio signal. Also, the apparatus may adjust, by using phase information of the non-lossy frequency band, a phase value of the lossy frequency band so as to resolve a discontinuity of a phase of the lossy frequency band.

When a discontinuous value is included in the audio spectrum where the component of the lossy frequency band is reconstructed or in the audio signal in a time domain, a sound quality may deteriorate during reproduction. When the audio signal is reconstructed, an audio signal of a predefined frequency band with respect to the cut-off frequency is copied to the frequency band where the audio data is lossy, such that the discontinuous value may exist. Therefore, the apparatus may adjust the value so as to allow a magnitude value and the phase information of the frequency band of the audio signal to have continuous values.

A method of reconstructing an audio signal according to an embodiment will be described in detail with reference to FIGS. 3 through 7 below.

Figure 2:
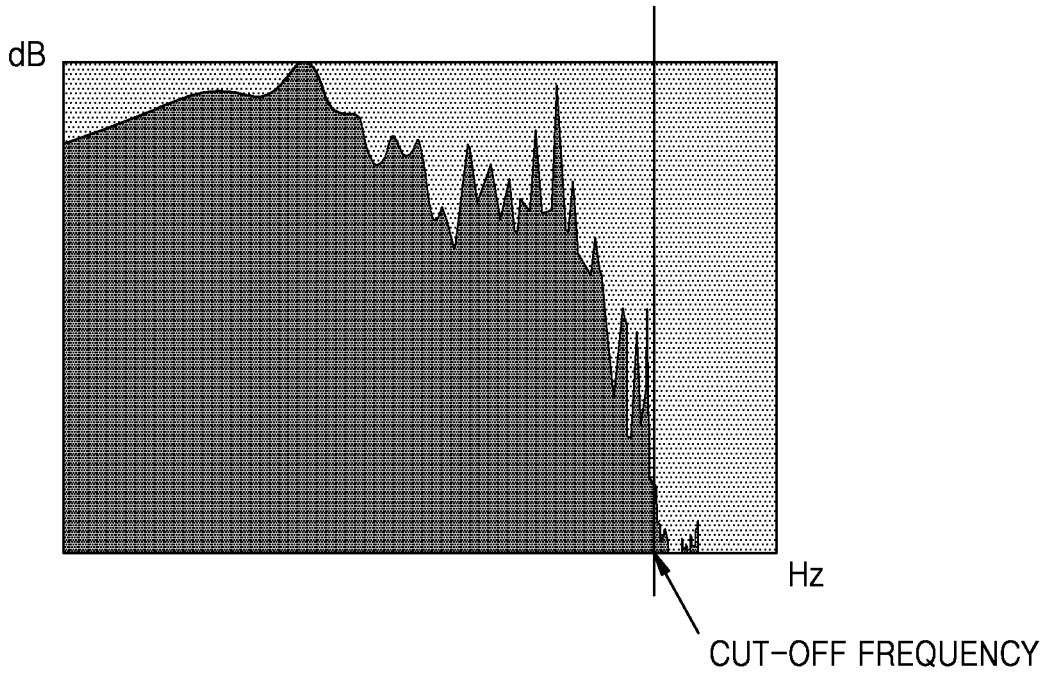
FIG. 2 illustrates an example of a cut-off frequency, according to an embodiment.

FIG. 2 illustrates an example of a cut-off frequency, according to an embodiment.

The cut-off frequency may be obtained, based on whether or not an energy of an audio spectrum is sharply decreased and whether or not a decreased energy value has 0 or a value close to 0.

Referring to FIG. 2, an amount of energy decrease between adjacent frequency bands is sharply increased at a cut-off frequency point, and a frequency energy value of a high frequency band with respect to the cut-off frequency has a value close to 0. Therefore, the apparatus may obtain a value of the cut-off frequency point shown in FIG. 2, as the cut-off frequency.

The apparatus may obtain the cut-off frequency according to an energy value of a frequency in a section that is estimated to include the cut-off frequency, according to compression information or data transmission information. The compression information may include information about a frequency band that may be lossy during compression. The data transmission information may include information about a frequency band that may be lossy during data transmission. The apparatus may obtain the cut-off frequency, based on, not limited to the aforementioned examples, various types of information including information about a lossy frequency band.

Figure 3:
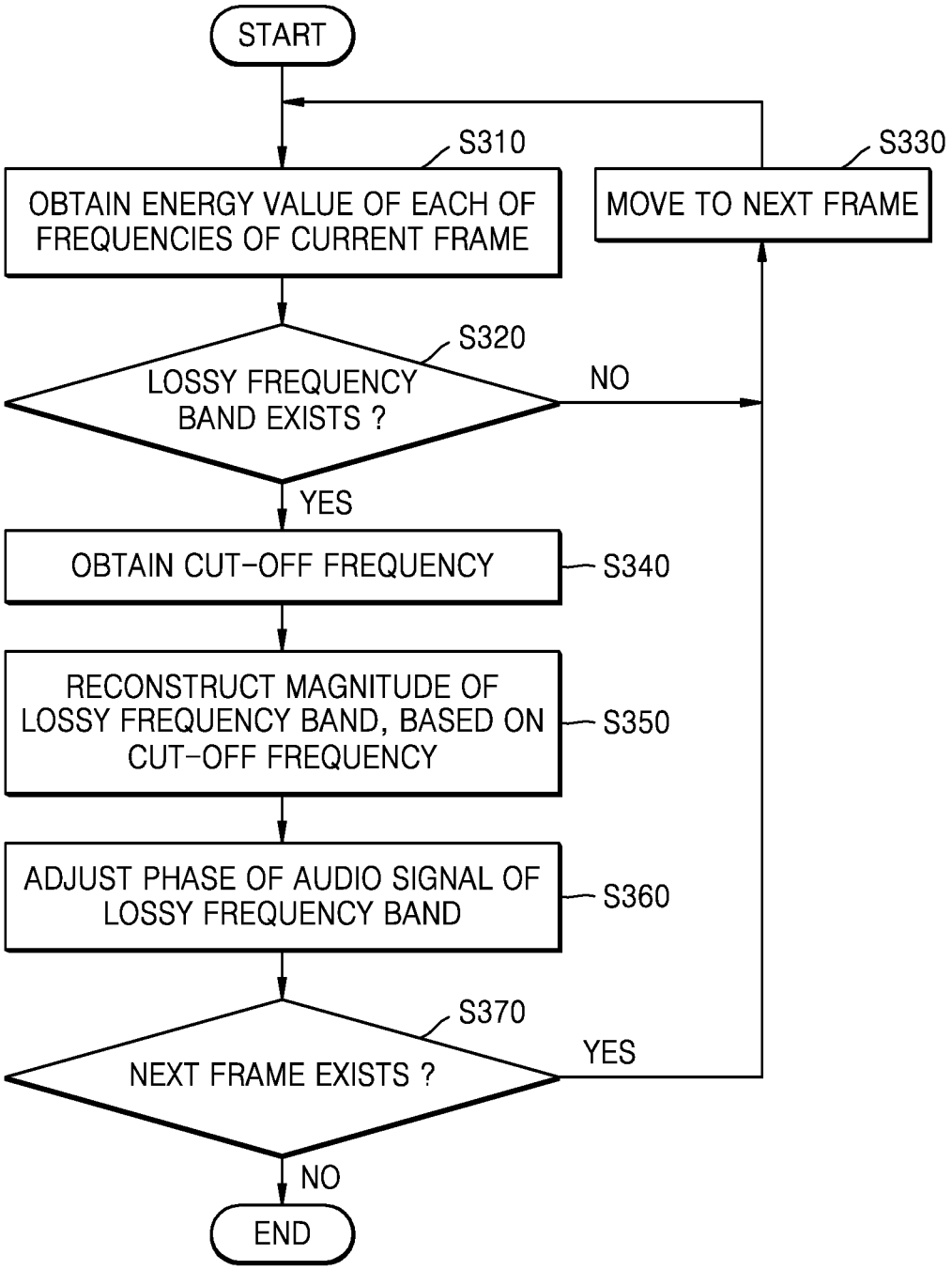
FIG. 3 is a flowchart illustrating a method of reconstructing an audio signal, according to an embodiment.

FIG. 3 is a flowchart illustrating a method of reconstructing an audio signal, according to an embodiment.

Referring to FIG. 3, in operation S310, the apparatus for reconstructing an audio signal may obtain an energy value of each of frequencies of a current frame. With respect to the current frame, the apparatus may obtain an audio spectrum indicating the energy value of each frequency. The apparatus may obtain an energy value of each frequency in various units of time, not limited to the current frame. Hereinafter, for convenience of description, it is described that an energy value of each frequency is obtained in a frame unit. The apparatus may perform frequency conversion on an audio signal in a time domain included in the current frame, and may obtain the audio spectrum indicating the energy value of each frequency.

In operation S320, the apparatus may determine whether a lossy frequency band exists. The apparatus may determine existence of a frequency domain where an amount of energy decrease is equal to or greater than a first reference value, and an energy value is equal to or less than a second reference value in a high frequency band of a predefined section with respect to a frequency point at the amount of energy decrease is equal to or greater than the first reference value. Alternatively, the apparatus may determine existence of a frequency domain where a representative value of energy values is equal to or less than the second reference value in the high frequency band of the predefined section with respect to the frequency point at the amount of energy decrease is equal to or greater than the first reference value. The representative value may include an average value, a middle value, or the like which indicates a characteristic of the energy values included in the predefined section. For example, if there is a domain where an energy is sharply decreased, the apparatus may detect, as a lossy frequency domain, a predefined frequency section where the representative value of the energy values has 0 or a value close to 0.

In operation S320, when the apparatus determines that the lossy frequency domain does not exist, it is not required to perform reconstruction on the audio signal of the current frame, thus, the apparatus may move to a next frame in operation S330. The apparatus may perform a reconstruction procedure of operations S310 through S360 on an audio signal of the next frame.

In operation S340, the apparatus may obtain a cut-off frequency, based on the lossy frequency domain detected in operation S320. At least one cut-off frequency may be detected according to the detected lossy frequency domain.

With respect to an audio signal including a frequency domain that is lossy due to compression, the apparatus may obtain, as a cut-off frequency, a greatest value from among a plurality of cut-off frequencies. When audio data of a high frequency band becomes lossy due to compression, the audio data in the high frequency band with respect to one frequency value may be lossy. Therefore, the apparatus may determine only one cut-off frequency with respect to the audio signal including the frequency domain that is lossy due to the compression. Not limited thereto, the apparatus may determine a plurality of cut-off frequencies with respect to the audio signal including the frequency band that is lossy due to the compression.

In operation S350, the apparatus may reconstruct a magnitude of the lossy frequency band, based on the cut-off frequency obtained in operation S340. The apparatus may reconstruct the audio data of the lossy frequency band by using audio data of a non-lossy frequency band, based on the cut-off frequency. For example, the apparatus may reconstruct an audio signal of the lossy frequency band by copying the audio data of the non-lossy frequency band to the lossy frequency band. A method of reconstructing the magnitude of the lossy frequency band will be described in detail with reference to FIGS. 4 through 5 below.

In operation S360, the apparatus may adjust a phase value of the audio signal of the lossy frequency band. In operation S350, an audio signal in a frequency domain is reconstructed in each frame, thus, if the copy-based reconstruction is performed, a discontinuous phase value may be generated in each frame in the time domain. Therefore, the apparatus may adjust, by using phase information of an audio signal in the non-lossy frequency band which is used in reconstruction in operation S350, the phase value of the audio signal of the lossy frequency band so as to prevent generation of a discontinuous value.

For example, the apparatus may compensate for the phase value by using phase information and a frequency value of the audio signal in the non-lossy frequency band which is used in the copying in operation S350. The apparatus may use the phase information and the frequency value with respect to the audio signal of a frequency in the non-lossy frequency band, wherein the frequency corresponds to a frequency value included in the lossy frequency band. The apparatus may adjust the phase value, so that the phase value corresponding to the lossy frequency band may have a continuous value.

After a phase of the audio signal is adjusted, in operation S370, the apparatus may determine whether or not a next frame exists. When the next frame exists, in operation S330, the apparatus may move to the next frame. The apparatus may perform a reconstruction procedure of operations S310 through S360 on an audio signal of the next frame.

A method of adjusting the phase value of the lossy frequency band will be described in detail with reference to FIGS. 6 through 7 below.

Figure 4:
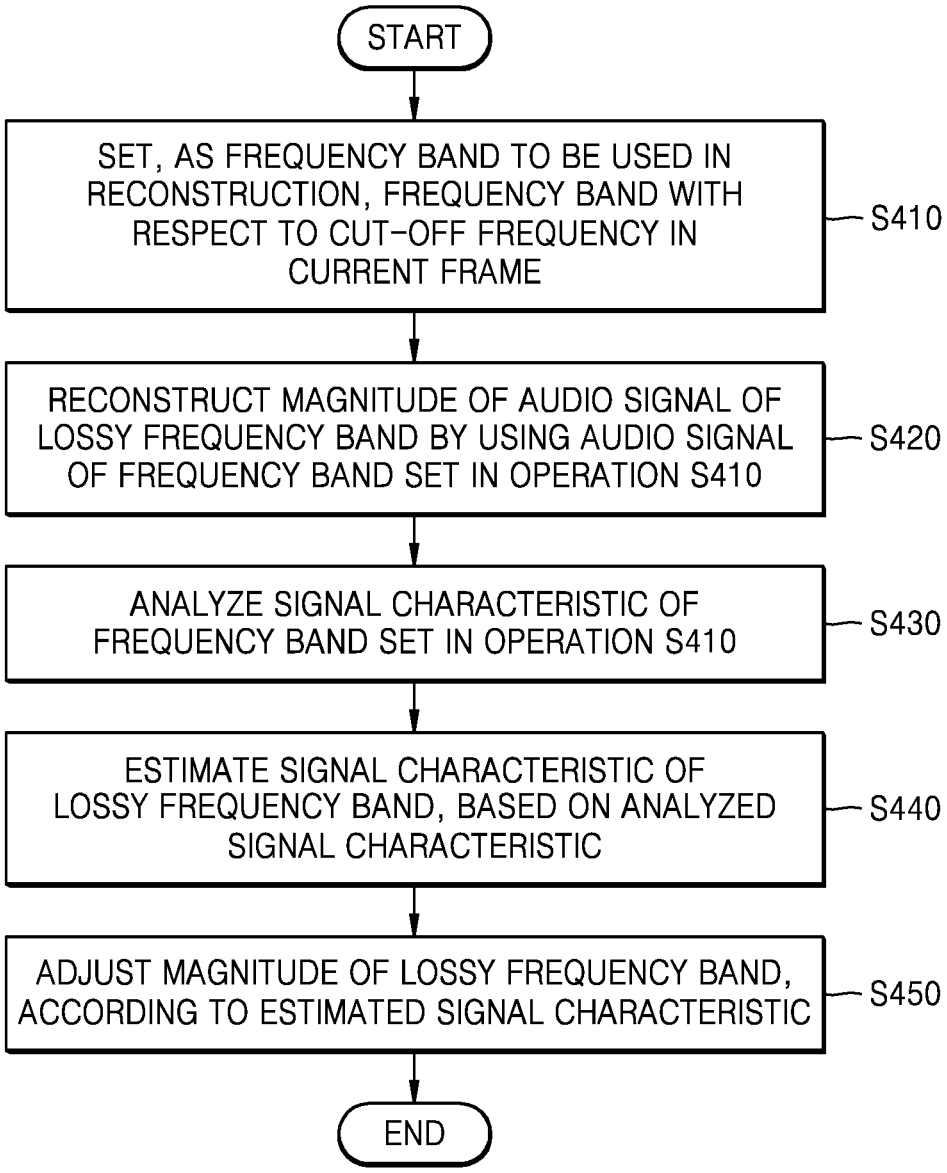
FIG. 4 is a flowchart illustrating a method of reconstructing a magnitude of a lossy frequency band, according to an embodiment.

FIG. 4 is a flowchart illustrating a method of reconstructing a magnitude of a lossy frequency band, according to an embodiment.

Referring to FIG. 4, in operation S410, the apparatus for reconstructing an audio signal may set, as a frequency band to be used in reconstruction, a frequency band with respect to a cut-off frequency in a current frame. The cut-off frequency may have been obtained in operation S120 of FIG. 1 or operation 340 of FIG. 3. For example, the apparatus may set a low frequency band of a predefined section with respect to the cut-off frequency, as the frequency band to be used in reconstruction as a non-lossy frequency band.

In operation S420, the apparatus may reconstruct an audio signal of the lossy frequency band by using an audio signal of the non-lossy frequency band set in operation S410. The lossy frequency band may be included in the frequency band detected in operation S110 of FIG. 1 or operation 320 of FIG. 3. The apparatus may copy a magnitude of the set frequency band to the lossy frequency band and thus may reconstruct the audio data of the lossy frequency band.

The apparatus may use a shift method by which an audio signal of the set frequency band is changelessly shifted and thus is copied, or may use a folding method by which the audio signal of the set frequency band rotates by 180 degrees and thus is copied. The apparatus may copy, by using the shifting method or the folding method, the audio signal of the set frequency band to the lossy frequency band.

For example, the apparatus may repeatedly perform copying in every predefined section of the lossy frequency band. As another example, the apparatus may perform copying on a section of the lossy frequency band by a magnitude of the set frequency band, and may perform estimation on residual sections, based on an audio signal of the copied section.

In operation S430, the apparatus may analyze a signal characteristic of the frequency band set in operation S410. Since a discontinuity may occur in each of frequency band for which copying was performed, the apparatus may analyze the signal characteristic of the frequency band set in operation S410 so as to resolve a discontinuity of a reconstructed frequency band. For example, the apparatus may analyze an envelope characteristic of the low frequency band set in operation S410. An envelope characteristic of a frequency band may mean a characteristic of the envelope of a frequency spectrum, e.g., characteristics such as a shape, a slope, or the like of the envelope on the spectrum. The envelope in the frequency spectrum may be formed as a constant curved line that contacts a group of straight lines or curved lines that repeatedly appear, and may be slowly changed according to a frequency change. Therefore, the apparatus may remove, by using the envelope characteristic of the low frequency band, the discontinuity of the frequency bands for which copying was performed.

In operation S440, the apparatus may estimate a signal characteristic of a high frequency band, based on the signal characteristic of the low frequency band which is analyzed in operation S430. For example, the apparatus may estimate an envelope characteristic of the high frequency band, based on the envelope characteristic of the low frequency band which is analyzed in the frequency spectrum.

In operation S450, the apparatus may compensate for a spectrum of the high frequency band, according to the signal characteristic estimated in operation S440. The spectrum may be, but is not limited to, an energy spectrum indicating an energy value of each frequency, and may include audio data of various types of a frequency domain.

For example, the apparatus may determine a weight to be applied to a spectrum of each frequency value, according to the envelope characteristic of the high frequency band which is estimated based on the envelope characteristic of the low frequency band. The apparatus may compensate for the spectrum of the high frequency band by applying the determined weight to the spectrum of the high frequency band.

Figure 5:
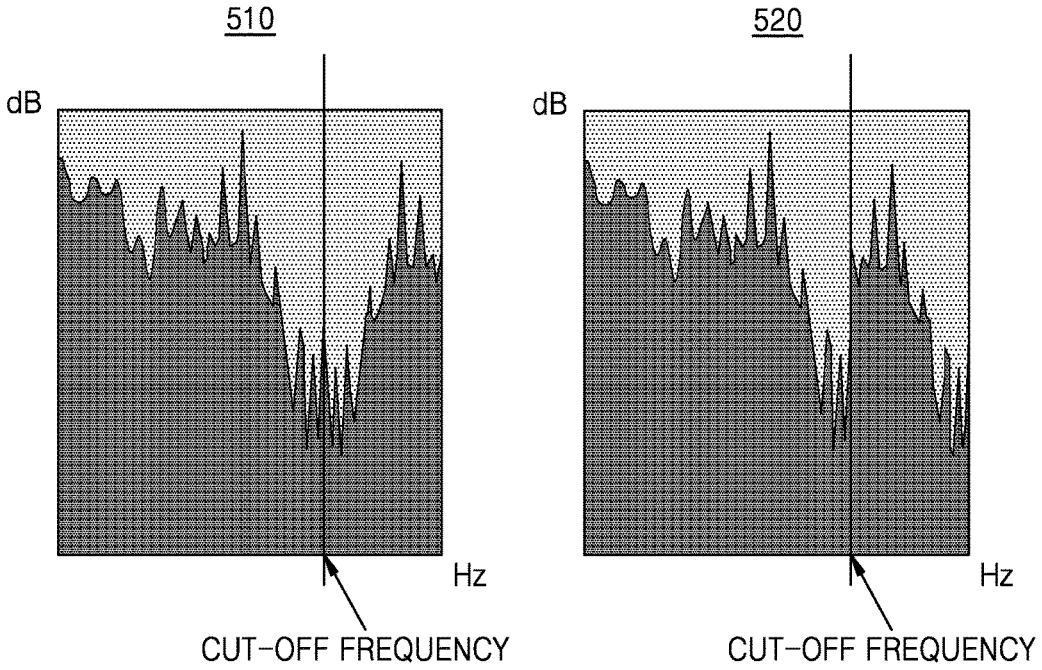
FIG. 5 illustrates an example in which a spectrum of an audio signal is reconstructed, according to an embodiment.

FIG. 5 illustrates an example in which a spectrum of an audio signal is reconstructed, according to an embodiment.

Referring to 510 of FIG. 5, according to a folding method by which a spectrum of a frequency band rotates by 180 degrees with respect to a cut-off frequency and thus is copied, a spectrum of a lossy frequency band may be reconstructed. Also, referring to 520, according to a shift method by which a magnitude of a frequency band is changelessly shifted with respect to a cut-off frequency and thus is copied, a spectrum of a lossy frequency band may be reconstructed.

The apparatus may perform the aforementioned operations S430 through S450 of FIG. 4 on the frequency band of which a magnitude is reconstructed according to the folding or shift method as in 510 and 520, and thus may resolve a discontinuity occurring at a point of the cut-off frequency. The apparatus may estimate an envelope characteristic of a high frequency band according to an envelope characteristic of a low frequency band, based on the cut-off frequency, and may compensate for a spectrum of the high frequency band according to the estimated envelope characteristic. The apparatus may resolve the discontinuity occurring at the point of the cut-off frequency by compensating for the spectrum of the high frequency band according to the estimated envelope characteristic.

Referring to 510 and 520, since discontinuous points exist on a frequency spectrum due to a copy with respect to the cut-off frequency, the apparatus may estimate the envelope characteristic of the high frequency band according to the envelope characteristic of the low frequency band. For example, the apparatus may estimate a slope value of an envelope of the high frequency band, according to a slope value of an envelope of the low frequency band. Also, the apparatus may compensate for a spectrum of the high frequency band so as to make an envelope at the point of the cut-off frequency have sequential values.

Hereinafter, with reference to FIGS. 6 through 7, a method of adjusting a phase value of a lossy frequency band will be described in detail.

Figure 6:
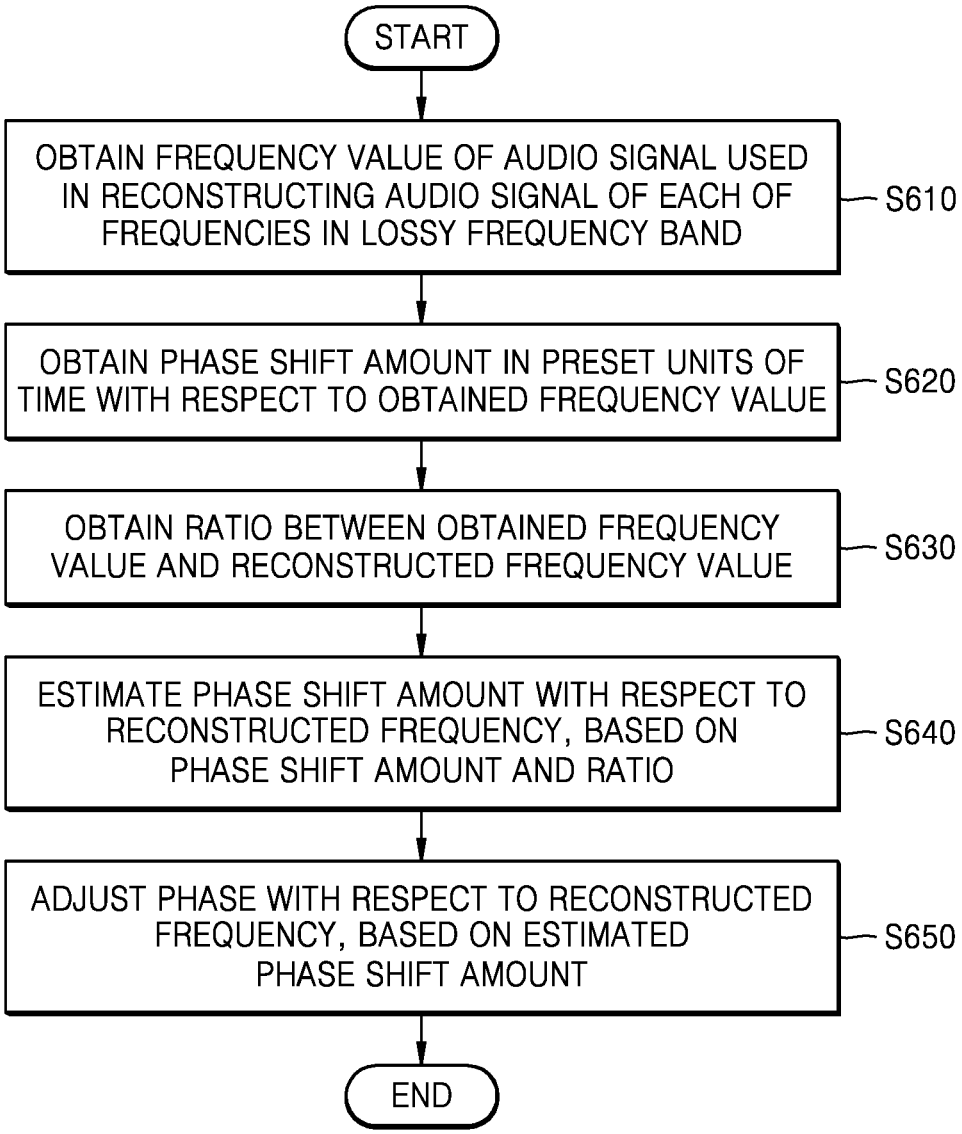
FIG. 6 is a flowchart illustrating a method of adjusting a phase of a lossy frequency band, according to an embodiment.

FIG. 6 is a flowchart illustrating a method of adjusting a phase of a lossy frequency band, according to an embodiment.

Referring to FIG. 6, in operation S610, the apparatus for reconstructing an audio signal may obtain a frequency value used in reconstructing a magnitude value of each of frequencies included in the lossy frequency band. The apparatus may obtain a frequency value used in reconstructing the magnitude of the lossy frequency band in FIG. 4 or in operation S350 of FIG. 3.

When a copy is performed in operation S420 of FIG. 4, a phase value of a copied frequency band signal is equal to a phase value of a frequency band signal used in the copy. However, an amount of a phase shift between frames of a low frequency component used in the copy and an amount of a phase shift between frames of a copied high frequency component may be different from each other. Therefore, after reconstruction, when an audio signal is reconverted to a time-domain signal, a discontinuity between frames may occur. Therefore, in order to resolve the discontinuity, the apparatus may adjust a phase value of frequencies included in a reconstructed frequency band, by using a frequency value used in the copy. The adjustment of the phase value may be performed on each of the frequencies included in the reconstructed frequency band.

For example, hereinafter, a case in which an audio signal of 5 kHz from among frequency values in a non-lossy frequency band is reconstructed as an audio signal of 10 kHz from among frequency values in a lossy frequency band will be described in detail.

In operation S620, the apparatus may obtain a phase shift amount in preset units of time with respect to the frequency value obtained in operation S610. For example, the apparatus may obtain a phase shift amount in a frame unit with respect to 5 kHz. When a phase shift amount between a current frame and a previous frame with respect to 5 kHz is $\pi$, the apparatus may obtain $\pi$ as the phase shift amount with respect to 5 kHz.

In operation S630, the apparatus may obtain a ratio between the frequency value obtained in operation S610 and a reconstructed frequency value. Since a cycle may vary according to a frequency value, a phase value may also vary. Therefore, the apparatus may adjust a phase value of a reconstructed frequency band, in consideration of the frequency value. For example, the apparatus may obtain 2 as a frequency value ratio between 5 kHz and 10 kHz.

In operation S640, the apparatus may estimate a phase shift amount of the reconstructed frequency value, based on the phase shift amount and the ratio obtained in operations S620 and S630. For example, the apparatus may estimate, as a phase shift amount of 10 kHz of the reconstructed frequency value, a $2\pi$ value per frame which is a value obtained by multiplying the phase shift amount by the ratio.

In operation S650, the apparatus may adjust a phase of the reconstructed frequency value, based on the phase shift amount estimated in operation S640. Before the phase is adjusted, the phase shift amount per frame of 10 kHz of the reconstructed frequency value is a it value that is equal to the phase shift amount per frame of 5 kHz, however, since the phase is adjusted, the phase shift amount per frame of 10 kHz of the reconstructed frequency value may be changed to $2\pi$. The apparatus may adjust the phase of the reconstructed frequency according to the ratio of the reconstructed frequency value to the frequency value used in the reconstruction, so that the apparatus may prevent a sound quality from deteriorating due to the discontinuity of the phase of the reconstructed frequency.

Figure 7:
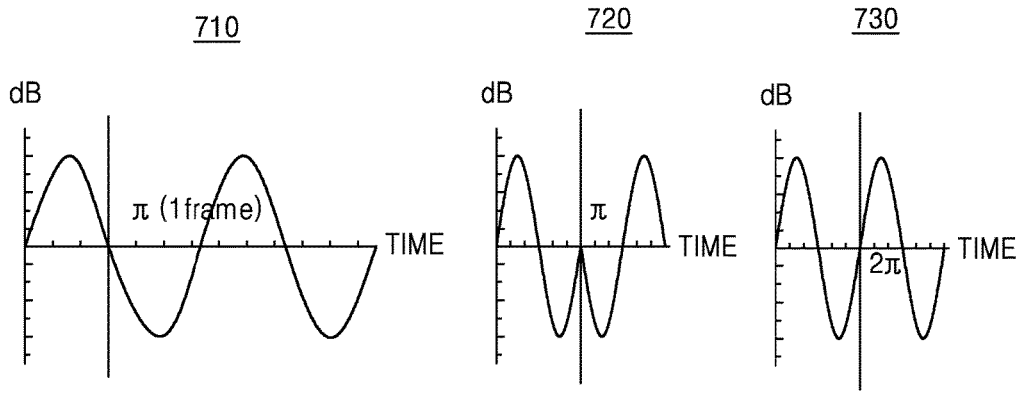
FIG. 7 illustrates an example in which a phase value of an audio signal is adjusted, according to an embodiment.

FIG. 7 illustrates an example in which a phase value of an audio signal is adjusted, according to an embodiment. In the example, a reconstructed frequency value is 10 kHz, and a frequency value used in reconstruction is 5 kHz.

710 of FIG. 7 is a graph showing a phase with respect to the frequency value used in reconstruction, in which a phase shift amount in one frame with respect to a frequency of 5 kHz is $\pi$.

720 of FIG. 7 is a graph showing a phase with respect to the reconstructed frequency value, and since the phase with respect to the frequency of 5 kHz is changelessly copied to the phase with respect to the frequency of 10 kHz, a phase shift amount in one frame may be shown as it that is the same as 5 kHz. Therefore, in a case of the phase with respect to the reconstructed frequency value, a discontinuity may occur in a unit of a frame.

730 is a graph showing a phase with respect to a reconstructed frequency value that is adjusted according to a frequency value ratio. The apparatus may estimate, as a phase shift amount of 10 kHz of the reconstructed frequency value, a 2 π value per frame which is a value obtained by multiplying the phase shift amount by the ratio, and may adjust the phase of the reconstructed frequency value according to the estimated phase shift amount. Therefore, the phase shift amount per frame of 10 kHz of the reconstructed frequency value may be changed to 2 π.

Hereinafter, with reference to FIG. 8, an internal structure of the apparatus for reconstructing an audio signal will be described in detail.

Figure 8:
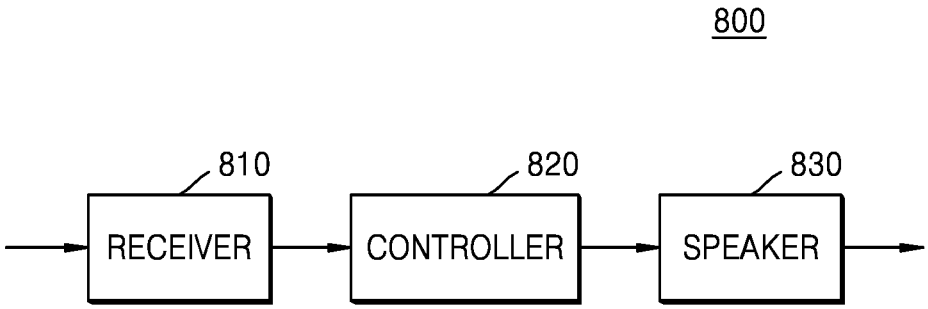
FIG. 8 is a block diagram illustrating an internal structure of an apparatus for reconstructing an audio signal, according to an embodiment.

FIG. 8 is a block diagram illustrating an internal structure of the apparatus for reconstructing an audio signal, according to an embodiment.

An apparatus 800 according to an embodiment may include, but is not limited to, a voice communication-dedicated terminal including a phone, a mobile phone, etc., a broadcasting or music-dedicated apparatus including a TV, an MP3 player, etc., or a convergence terminal apparatus of the voice communication-dedicated terminal and the broadcasting or music-dedicated apparatus. Also, the apparatus 800 may be used as a client, a server, or a converter disposed between the client and the server.

Referring to FIG. 8, the apparatus 800 may include a receiver 810, a controller 820, and a speaker 830.

The receiver 810 may obtain an audio signal to be reconstructed. The audio signal may be a pulse code modulation (PCM) signal in a time domain. An encoded audio signal may be decoded and thus may be converted to the PCM signal.

The receiver 810 may be configured to transmit and receive data with an external device via a wireless network such as wireless internet, wireless intranet, a wireless telephone network, a wireless LAN, Wi-Fi, Wi-Fi Direct (WFD), third generation (3G), fourth generation (4G), Bluetooth, Infrared Data Association (IrDA), Radio Frequency Identification (RFID), Ultra WideBand (UWB), ZigBee, or Near Field Communication (NFC), or a wired network such as a wired telephone network, wired internet, and the like.

The controller 820 may reconstruct the audio signal received by the receiver 810. The controller 820 may convert the audio signal in a time domain to a signal in a frequency domain, and may detect a lossy frequency band, based on an energy value of a frequency. The controller 820 may determine a cut-off frequency, based on the lossy frequency band, and may reconstruct an audio signal of the lossy frequency band, based on the cut-off frequency.

The controller 820 may reconstruct the audio signal of the lossy frequency band by using an audio signal of a non-lossy frequency band, based on the cut-off frequency. The controller 820 may reconstruct a magnitude of the lossy frequency band by using a copying method such as a shift method or a folding method. Also, in order to resolve a discontinuity of a phase, the controller 820 may adjust a phase value of a reconstructed frequency value, based on an audio signal of a frequency band which is used in the reconstruction.

The speaker 830 may externally output the audio signal reconstructed by the controller 820.

Meanwhile, in a case where the apparatus 800 is a mobile phone, although not illustrated, the apparatus 800 may further include a user input unit such as a keypad, a display unit configured to display information processed in a user interface or the mobile phone, and a processor configured to control general functions of the mobile phone. In addition, the mobile phone may further include a camera unit having an image-capturing function, and one or more elements configured to perform functions required by the mobile phone.

When the apparatus 800 is a TV, although not illustrated, the apparatus 800 may further include a user input unit such as a keypad, a display unit configured to display received broadcasting information, and a processor configured to control general functions of the TV. In addition, the TV may further include one or more elements configured to perform functions required by the TV.

According to an embodiment, a lossy frequency domain of an audio signal is reconstructed, so that a sound quality of the audio signal may be improved.

The method according to some embodiments can be embodied as programmed commands to be executed in various computer means, and then can be recorded to a computer readable recording medium. The computer readable recording medium may include one or more of the programmed commands, data files, data structures, or the like. The programmed commands recorded to the computer readable recording medium may be particularly designed or configured for the invention or may be well known to one of ordinary skill in the art. Examples of the computer readable recording medium include magnetic media including hard disks, magnetic tapes, and floppy disks, optical media including CD-ROMs, and DVDs, magneto-optical media including floptical disks, and a hardware apparatus designed to store and execute the programmed commands in ROM, RAM, flash memories, and the like. Examples of the programmed commands include not only machine codes generated by a compiler but also include great codes to be executed in a computer by using an interpreter.

While the detailed description has been particularly described with reference to non-obvious features of the present invention, it will be understood by one of ordinary skill in the art that various deletions, substitutions, and changes in form and details of the aforementioned apparatus and method may be made therein without departing from the spirit and scope of the following claims. Therefore, the scope of the present invention is defined not by the detailed description but by the appended claims, and all differences within the scope will be construed as being included in the present invention.

The invention claimed is:

1. A method of reconstructing an audio signal in an apparatus, the method comprising:

detecting a lossy frequency band, based on an energy value of each of frequencies of the audio signal;

obtaining a cut-off frequency, based on the lossy frequency band;

determining a frequency band to be used in reconstructing the audio signal based on the cut-off frequency;

reconstructing the audio signal of the lossy frequency band, by using an audio signal of the determined frequency band; and outputting the reconstructed audio signal via a speaker, wherein the reconstructing comprises:

determining a ratio between a first frequency value and a second frequency value if an audio signal of the second frequency value included in the lossy frequency band is reconstructed based on an audio signal of the first frequency value in the determined frequency band;

determining a phase shift amount in preset unit of time with respect to the second frequency value, based on the determined ratio; and adjusting a phase with respect to the second frequency value, based on the determined phase shift amount.

2. The method of claim 1, wherein the detecting comprises:

converting the audio signal to a signal in a frequency domain;

detecting a frequency band from the audio signal in the frequency domain, wherein an amount of energy decrease in the frequency band is equal to or greater than a first reference value; and detecting, based on the detected frequency band, a section where an energy value is equal to or less than a second reference value, as the lossy frequency band.

3. The method of claim 1, wherein the reconstructing comprises:

analyzing a signal characteristic of the determined frequency band;

estimating a signal characteristic of the lossy frequency band, based on the analyzed signal characteristic; and adjusting a magnitude of the lossy frequency band, based on the estimated signal characteristic.

4. The method of claim 1, wherein the cut-off frequency is determined in preset units of time, and wherein the audio signal of the lossy frequency band is reconstructed in the preset units of time, based on the cut-off frequency.

5. The method of claim 1, wherein, when a plurality of cut-off frequencies determined based on the detected frequency band exist, the obtaining of the cut-off frequency comprises determining a greatest value from among the determined cut-off frequencies, as the cut-off frequency.

6. An apparatus for reconstructing an audio signal, the apparatus comprising:

a receiver configured to obtain the audio signal;

a controller configured to detect a lossy frequency band, based on an energy value of each of frequencies of the audio signal, to obtain a cut-off frequency, based on the lossy frequency band, to determine a frequency band to be used in reconstructing the audio signal based on the cut-off frequency, and to reconstruct the audio signal of the lossy frequency band, by using an audio signal of the determined frequency band; and a speaker configured to output the reconstructed audio signal, wherein the controller is further configured to:

determine a ratio between a first frequency value and a second frequency value if an audio signal of the second frequency value included in the lossy frequency band is reconstructed based on an audio signal of the first frequency value in the determined frequency band, determine a phase shift amount in preset unit of time with respect to the second frequency value, based on the determined ratio, and adjust a phase with respect to the second frequency value, based on the determined phase shift amount.

7. The apparatus of claim 6, wherein the controller is further configured to convert the audio signal to a signal in a frequency domain, to detect a frequency band from the audio signal in the frequency domain, wherein an amount of energy decrease in the frequency band is equal to or greater than a first reference value, and to detect, based on the detected frequency band, a section where an energy value is equal to or less than a second reference value, as the lossy frequency band.

8. The apparatus of claim 6, wherein, when a plurality of cut-off frequencies determined based on the detected frequency band exist, the controller is further configured to determine a greatest value from among the determined cut-off frequencies, as the cut-off frequency.

9. A method of extending a bandwidth of an audio signal, the method comprising:

extending an audio signal of a first bandwidth to an audio signal of a second bandwidth;

determining a ratio between a first frequency value and a second frequency value if an audio signal of the second frequency value included in the second bandwidth is reconstructed based on an audio signal of the first frequency value in the first bandwidth;

determining a phase shift amount in preset unit of time with respect to the second frequency value, based on the determined ratio; and adjusting a phase with respect to the second frequency value, based on the determined phase shift amount.

10. A non-transitory computer-readable recording medium having recorded thereon a program that is executed by a computer to perform the method of claim 1.

* * * * *